US009235190B2

(12) United States Patent
Suzuki

(10) Patent No.: US 9,235,190 B2
(45) Date of Patent: Jan. 12, 2016

(54) IMAGE FORMING APPARATUS AND FIXING DEVICE

(71) Applicant: BROTHER KOGYO KABUSHIKI KAISHA, Nagoya-shi, Aichi-ken (JP)

(72) Inventor: Kaoru Suzuki, Ichinomiya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/629,956

(22) Filed: Feb. 24, 2015

(65) Prior Publication Data

US 2015/0248108 A1 Sep. 3, 2015

(30) Foreign Application Priority Data

Mar. 3, 2014 (JP) ..... 2014-040705

(51) Int. Cl.
*G03G 21/20* (2006.01)
*G03G 15/20* (2006.01)

(52) U.S. Cl.
CPC ..... *G03G 21/206* (2013.01); *G03G 15/2014* (2013.01)

(58) Field of Classification Search
USPC ..... 399/38, 67, 69, 91, 92, 107, 110, 122, 399/320, 328–334; 219/216, 619
See application file for complete search history.

(56) References Cited

U.S. PATENT DOCUMENTS

2008/0025746 A1* 1/2008 Kanai ..... G03G 15/2064 399/69
2009/0016764 A1* 1/2009 Kitozaki ..... G03G 15/2039 399/92
2011/0274463 A1* 11/2011 Taguchi et al. ..... G03G 21/206 399/122
2012/0282002 A1* 11/2012 Murasaki ..... G03G 15/2017 399/329

FOREIGN PATENT DOCUMENTS

JP 9-251253 A 9/1997
JP 2004-287035 A 10/2004
JP 2009-180839 A 8/2009
JP 2010-181667 A 8/2010

* cited by examiner

*Primary Examiner* — Hoan Tran
(74) *Attorney, Agent, or Firm* — Merchant & Gould PC

(57) ABSTRACT

An image forming apparatus includes a photosensitive member, a fixing device, and a fan. The fixing device includes a heating member, a pressing member, and a frame. The heating member includes a heater configured to generate heat, a cylindrical member storing the heater therein, and first and second support terminals disposed at first and second ends of the heater, respectively, in a longitudinal direction of the heater, the first and second support terminals supporting the heater. The frame is made of resin, and includes a first support terminal supporting portion supporting the first support terminal of the heater and a second support terminal supporting portion supporting the second support terminal of the heater. The frame further includes a duct portion disposed proximate to the first support terminal supporting portion, the duct portion through which air flows to the fan.

17 Claims, 10 Drawing Sheets

IMAGE FORMING APPARATUS AND FIXING DEVICE

CROSS REFERENCE TO RELATED APPLICATION

This application claims priority from Japanese Patent Application No. 2014-040705, filed on Mar. 3, 2014, which is incorporated herein by reference in its entirety.

TECHNICAL FIELD

Aspects of the disclosure relate to an electrophotographic image forming apparatus and a fixing device for use in the image forming apparatus.

BACKGROUND

Some known electrophotographic image forming apparatuses include a fixing device including a heating member configured to heat a developer transferred onto a sheet and a pressing member configured to press the sheet to the heating member.

SUMMARY

The electrophotographic image forming apparatuses need to prevent fine particles of, for example, developer or toner, from emitting. The inventor researched fine particles emitted from an electrographic image forming apparatus and found the following point.

The inventor has found that, in a case where a frame supporting a heater of the fixing device is made of resin, ultra-fine particles appear when the temperature of the frame exceeds a specified temperature determined according to the resin material.

Illustrative aspects of the disclosure provide an electrophotographic image forming apparatus configured to prevent emission of fine particles.

According to an aspect of the disclosure, an image forming apparatus includes a photosensitive member configured to carry a developer image thereon, a fixing device, and a fan configured to generate airflow. The fixing device includes a heating member configured to heat the developer image transferred from the photosensitive member onto the sheet, a pressing member configured to press the sheet toward the heating member, and a frame. The heating member includes a heater configured to generate heat and extending in a direction parallel to a width direction of the sheet being fed, a cylindrical member storing the heater therein, each end of the cylindrical member in an axial direction thereof being open, and first and second support terminals disposed at first and second ends of the heater, respectively, in a longitudinal direction of the heater, the first and second support terminals supporting the heater. The frame is made of resin, and includes a first support terminal supporting portion supporting the first support terminal of the heater and a second support terminal supporting portion supporting the second support terminal of the heater. The fan is disposed proximate to the first support terminal supporting portion. The frame further includes a duct portion disposed proximate to the first support terminal supporting portion, the duct portion through which air flows to the fan.

As the frame is provided with the duct portion proximate to the first support terminal supporting portion, a portion of the frame proximate to the first support terminal supporting portion can be subjected to cooling by air led through the duct portion.

This cooling can prevent excessive temperature rise of the resin constituting the frame, and thus prevent an occurrence of ultra-fine particles from the frame. In other words, this cooling can prevent the emission of ultra-fine particles from the image forming apparatus.

BRIEF DESCRIPTION OF THE DRAWINGS

Reference is made to the following description taken in connection with the accompanying drawings, like reference numerals being used for like corresponding parts in the various drawings.

DETAILED DESCRIPTION

An embodiment of the disclosure will be described with reference to the following drawings. The following description will be first made to a general structure of an electrophotographic image forming apparatus 1 according to the embodiment of the disclosure.

In the following description, the expressions "front", "rear", "upper or top", "lower or bottom", "right", and "left" are used to define the various parts when the image forming apparatus 1 is disposed in an orientation in which it is intended to be used.

For members or portions designated by numerals, at least one is provided unless "plural" or "two or more" is specifically stated otherwise.

Figure 1:
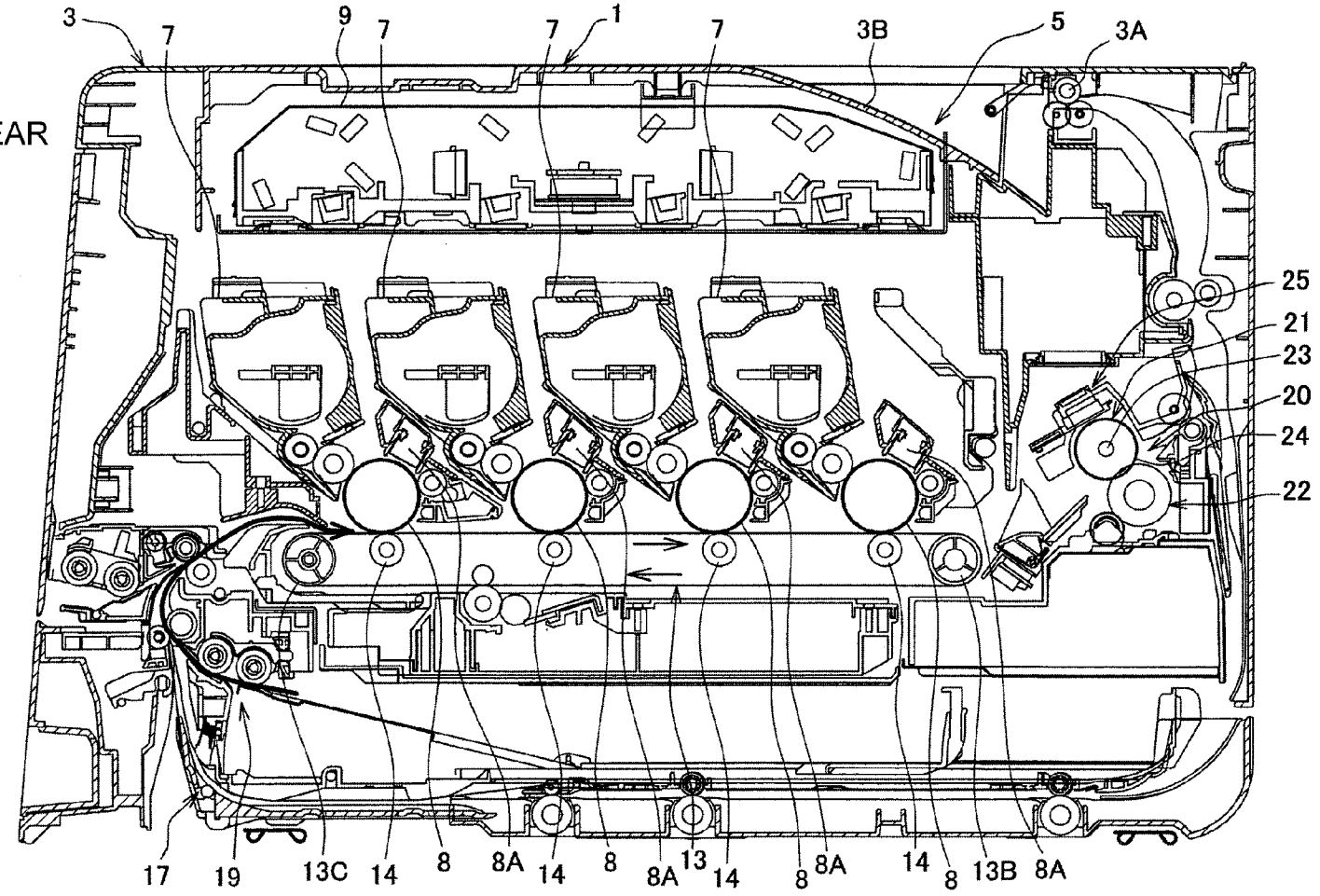
FIG. 1 is a sectional view illustrating a general structure of an image forming apparatus according to a first illustrative embodiment.

As illustrated in FIG. 1, the image forming apparatus 1 includes, in a casing 3, an electrophotographic image forming unit 5 configured to form an image on a recording medium, e.g., a sheet. The image forming unit 5 includes a plurality of developing cartridges 7, a plurality of photosensitive members 8, a plurality of chargers 8A, a light exposure unit 9, and a fixing unit 20 as an example of a fixing device.

Each of the developing cartridges 7 contains a different color developer (for example, one of yellow, magenta, cyan, and black). The photosensitive members 8 and the chargers 8A are provided in the same number as the developing cartridges 7. Each of the chargers 8A is configured to charge a corresponding one of the photosensitive members 8.

The light exposure unit 9 is configured to expose each charged photosensitive member 8. Each exposed photosensitive member 8 has an electrostatic latent image formed thereon. When a developer is supplied to the photosensitive member 8 having the electrostatic latent image formed thereon, a developer image corresponding to the electrostatic latent image is carried on a peripheral surface of the photosensitive member 8.

A belt 13 is a wide endless belt and is configured to rotate while extending between a roller 13B and a roller 13C, which are spaced apart from each other. The belt 13 according to the embodiment is configured to feed a sheet, on which an image is to be formed, toward the fixing unit 20.

Transfer members 14 are disposed in one-to-one correspondence with the photosensitive members 8 such that the belt 13 is sandwiched between each of the transfer members 14 and a corresponding one of the photosensitive members 8. Each of the transfer members 14 is configured to transfer a developer image carried on a corresponding one of the photosensitive members 8 to a sheet. Thus, developer images, which are carried on the respective photosensitive members 8, are sequentially transferred and overlaid one over the other on a sheet conveyed on the belt 13.

The fixing unit 20 is configured to fix developer images transferred onto a sheet by heating the developer images through the application of pressure. A sheet having an image formed thereon is ejected by an ejection roller 3A onto an ejection tray 3B disposed in an upper portion of the casing 3.

A feeder mechanism 19 is disposed upstream from the belt 13 in a sheet feed direction. The feeder mechanism 19 is configured to feed sheets one by one from a sheet supply tray 17 toward the image forming unit 5.

Figure 2:
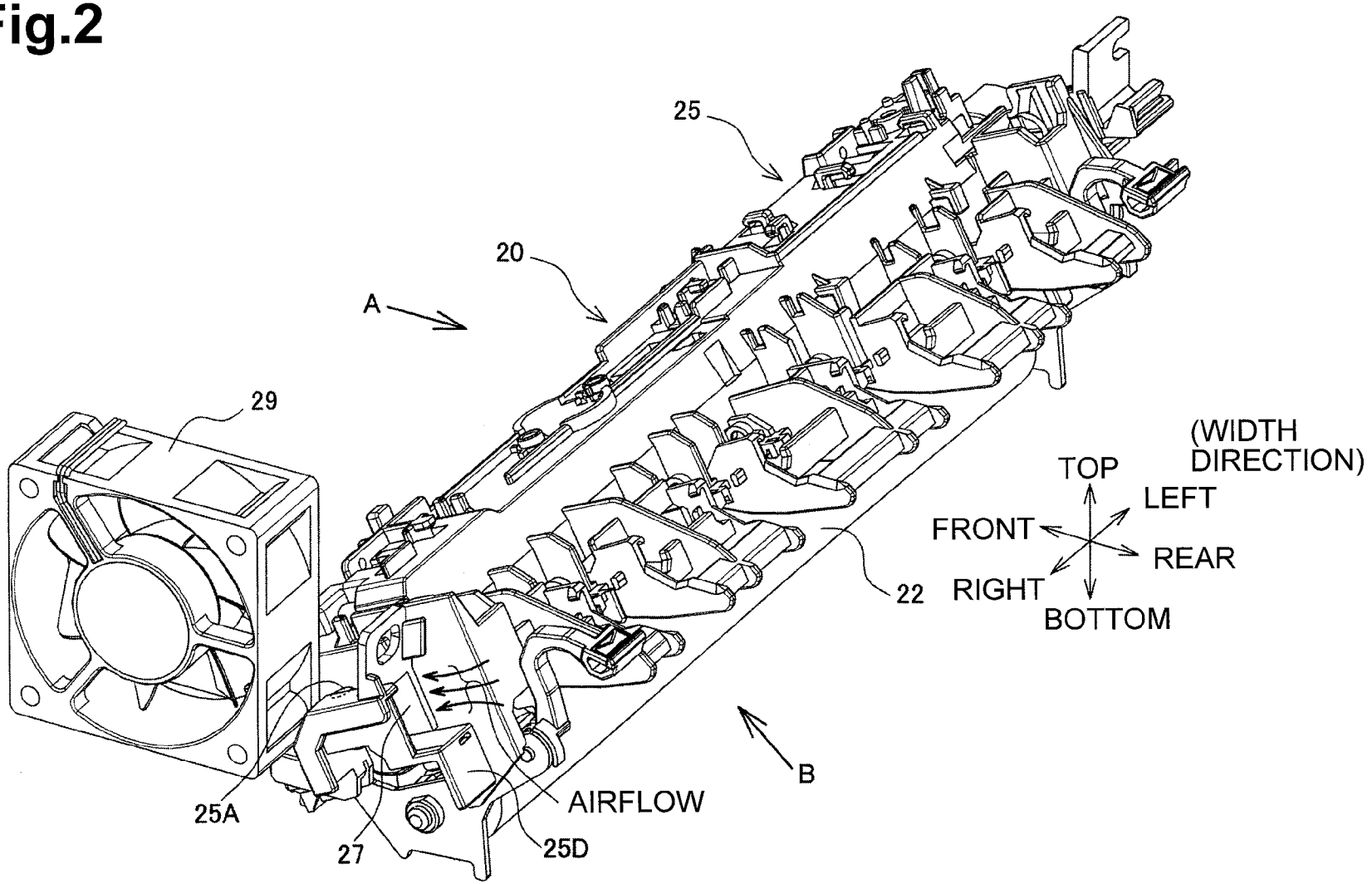
FIG. 2 is a perspective view of a fixing unit and a fan.
Figure 3:
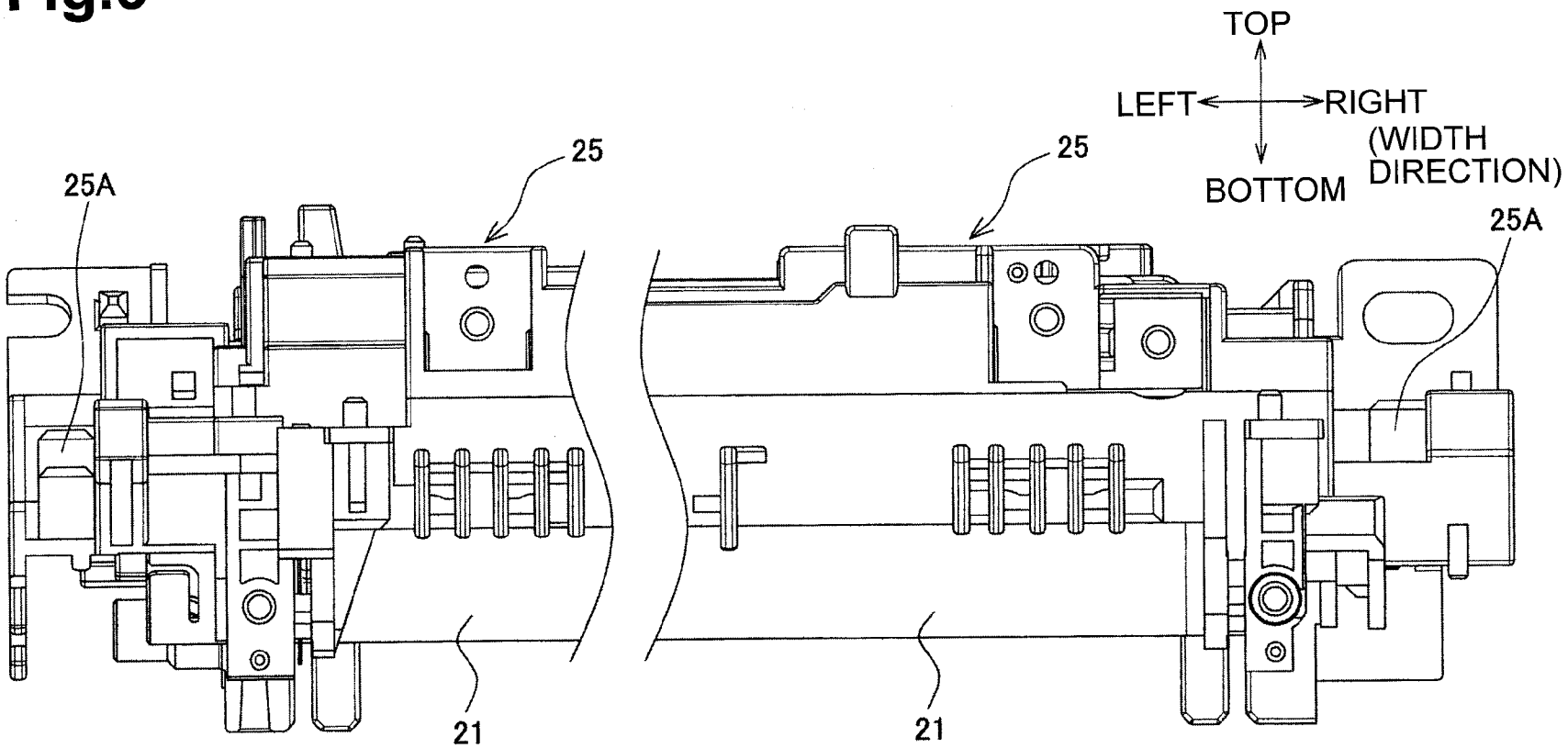
FIG. 3 is a fragmentary view taken in the direction of an arrow A of FIG. 2.
Figure 4:
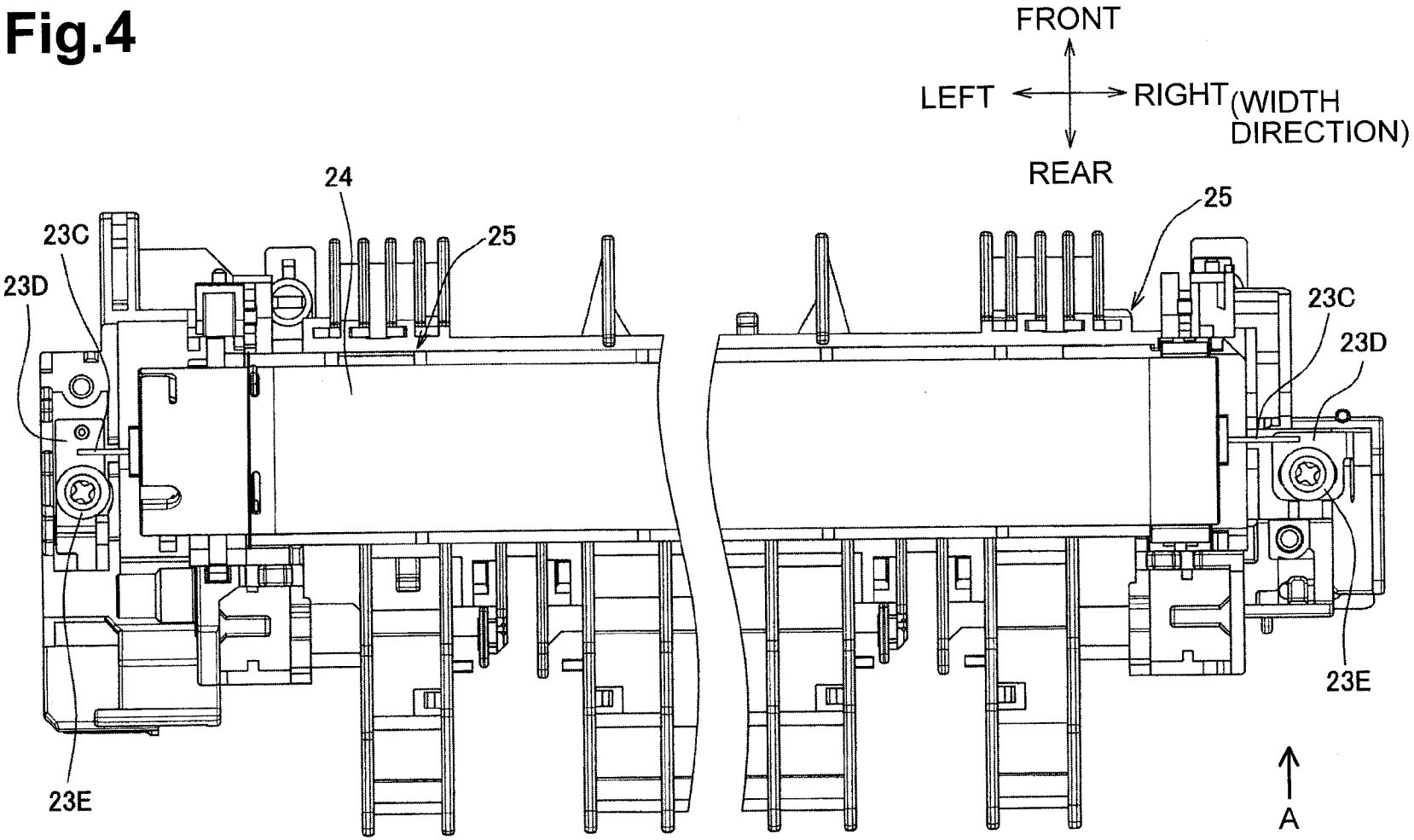
FIG. 4 is a fragmentary view taken in the direction of an arrow B of FIG. 2.

As illustrated in FIGS. 2 to 4, the fixing unit 20 includes a heating member 21, a pressing member 22, and a frame 25. In FIG. 3, the pressing member 22 is omitted to illustrate an outer shape of the heating member 21.

The heating member 21 is configured to heat developer images transferred from the photosensitive members 8 to a sheet. As illustrated in FIG. 1, the pressing member 22 is disposed opposite to the heating member 21 such that a sheet passes therebetween, and is configured to press the sheet to the heating member 21.

Figure 7:
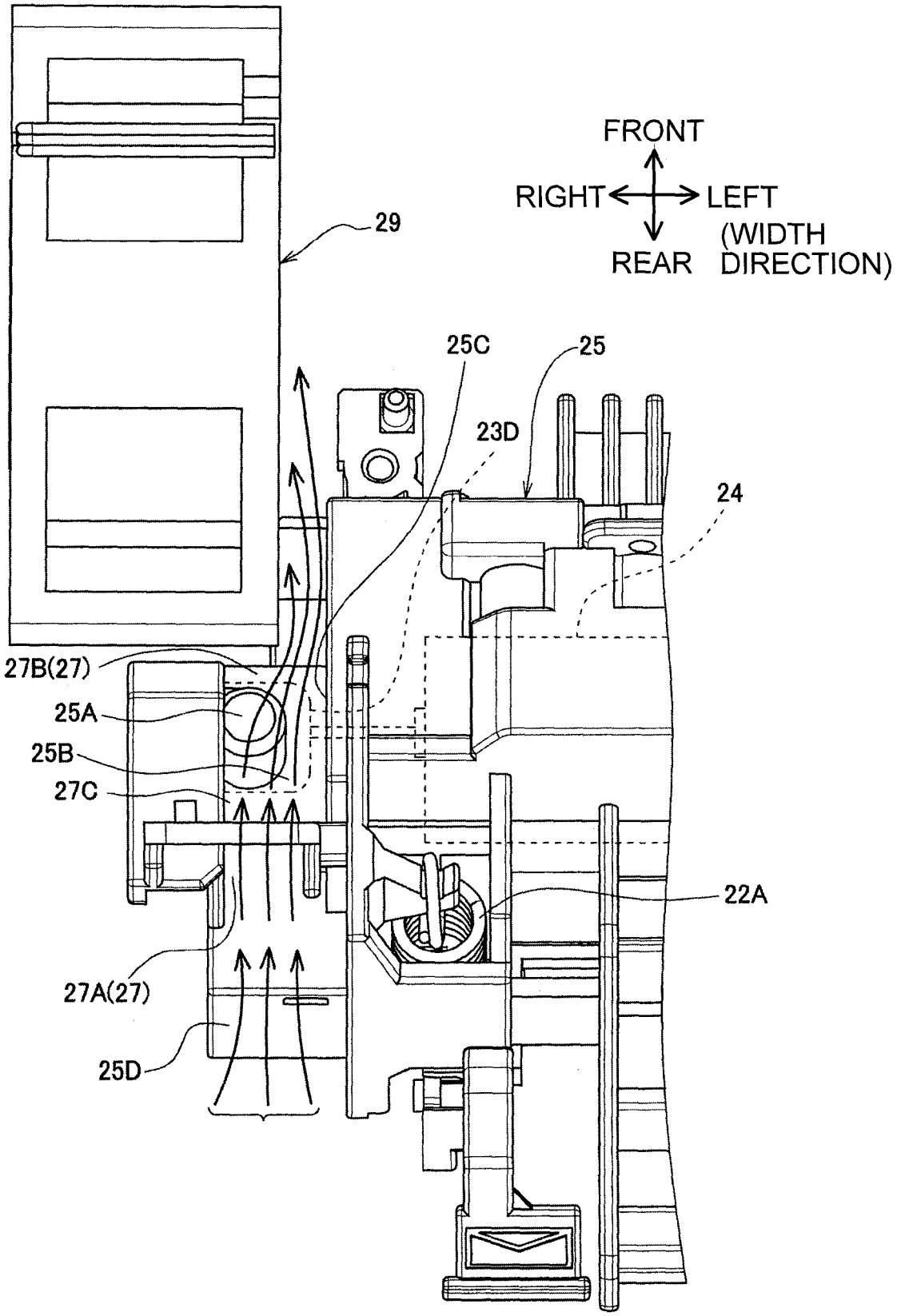
FIG. 7 is a rear view of the part A illustrated in FIG. 4.

The pressing member 22 according to the embodiment is a cylindrical-shaped driven roller configured to rotate along with movement of a sheet. The pressing member 22 is assembled to the frame 25 such that the pressing member 22 is movable relative to the heating member 21. The pressing member 22 is pressed against the heating member 21 by an elastic force of an elastic member 22A such as a coil spring (FIG. 7).

Figure 5:
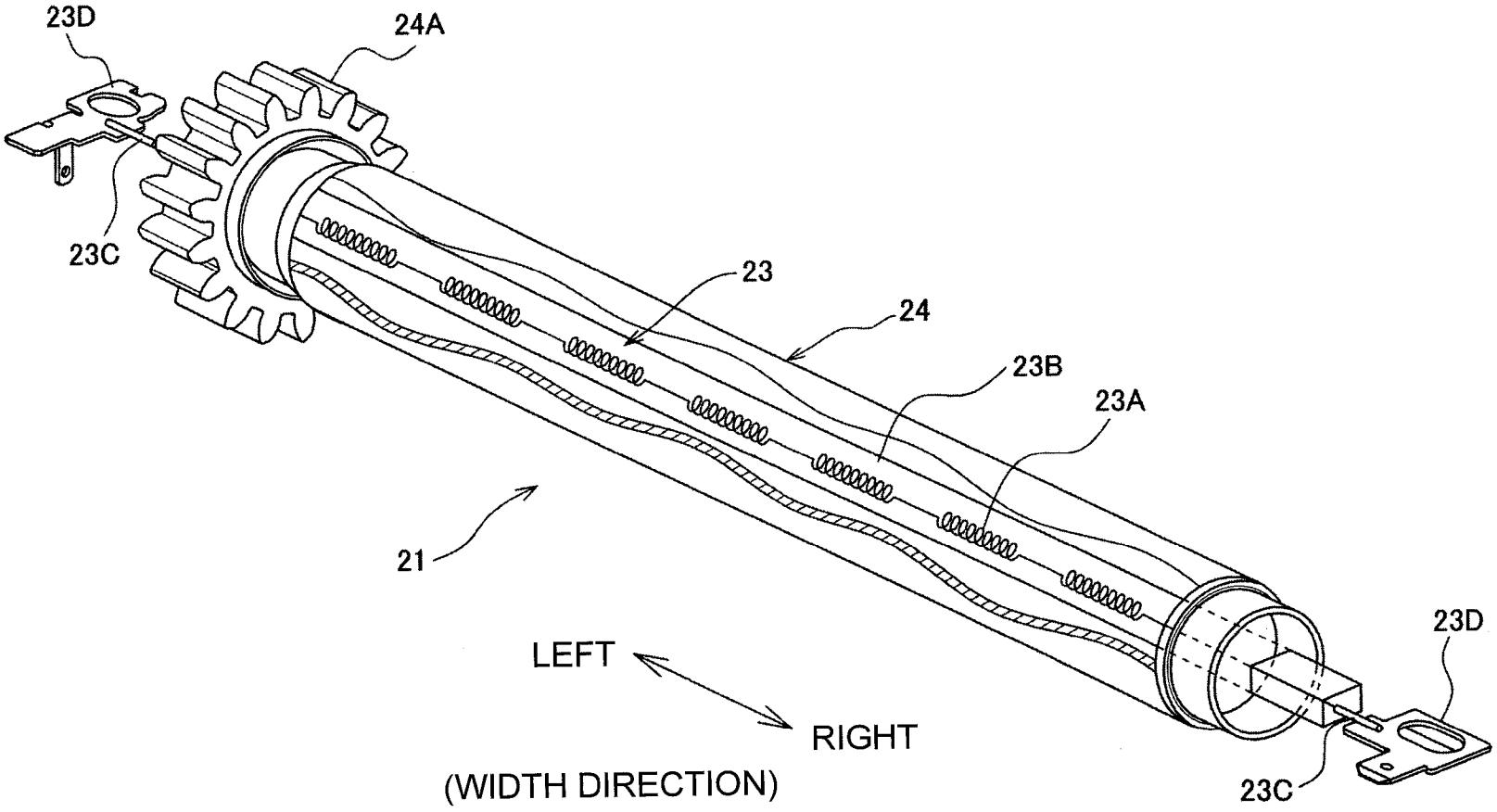
FIG. 5 is a perspective view of a heating member.

As illustrated in FIG. 5, the heating member 21 includes a heater 23 and a cylindrical member 24. The heater 23 is a thin-tube member extending in a direction parallel to a width direction of a sheet to be conveyed and configured to generate heat.

Specifically, the heater 23 has a plurality of heating elements 23A connected in series in the width direction, and a thin tube 23B made of glass and containing the heating elements 23A. The width direction refers to a direction perpendicular to the sheet feed direction and a sheet thickness direction. In this embodiment, the width direction agrees with a left-right direction of the image forming apparatus 1.

Both ends of the thin tube 23B are hermetically sealed. The thin tube 23B is charged with inert gas including halogens. Terminal pins 23C are attached to respective ends of the thin tube 23B of the heater 23.

One end of each terminal pin 23C is electrically connected to the heating elements 23A and the other end of each terminal pin 23C is soldered to a corresponding support terminal 23D made of metal. The support terminals 23D are located at respective ends of the heater 32 in a longitudinal direction of the heater 23 and support the heater 23. The heating elements 23A are electrically connected to a power supply (not illustrated) via the terminal pins 23C and the support terminals 23D.

The cylindrical member 24 is a pipe member of which both ends, in a central axial direction of the cylindrical member 24, are open. The heater 23 is disposed on the central axis of the cylindrical member 24. One end of the cylindrical member 24 in the central axial direction (that is, a left end in FIG. 5) is provided with a gear 24A for rotating the cylindrical member 24. The cylindrical member 24 is made of light metal such as aluminum and the gear 24A is made of resin.

As illustrated in FIG. 4, the support terminals 23D are held at respective end portions of the frame 25 in a longitudinal direction of the frame 25. The frame 25 extends in the width direction and is made of resin. The support terminals 23D disposed at the respective end portions of the heater 23 in the longitudinal direction are secured with metal screws 23E to the respective end portions of the frame 25 in the longitudinal direction.

The screws 23E are screwed into the frame 25 with their heads located toward the pressing member 22. As illustrated in FIG. 3, each internal thread portion 25A to couple with a corresponding screw 23E protrudes to a side of a support plate portion 25B opposite to the head of a corresponding screw 23E illustrated in FIG. 6 (hereinafter also referred to as an upper surface of the support plate portion 25B).

The support plate portions 25B are plate-shaped portions integrally formed with the frame 25 and contacting the respective support terminals 23D. As illustrated in FIG. 3, the internal thread portions 25A are cylindrical portions integrally formed with the upper surfaces of the respective support plate portions 25B. A side of each support plate portion 25B facing the corresponding support terminal 23D may be referred to as a lower surface of each support plate 25B. In this embodiment, the support plate portions 25B are illustrated as an example of support terminal supporting portions.

As illustrated in FIG. 2, a duct portion 27 is provided in one end portion of the frame 25 in the longitudinal direction. In this embodiment, the duct portion 27 is disposed in a right end portion of the frame 25 opposite to the gear 24A. The duct portion 27 is for allowing air to flow toward the one end portion of the frame 25. As illustrated in FIG. 7, the duct portion 27 includes a lead-in portion 27A and a lead-out portion 27B and forms an airflow path 27C for letting air in a direction perpendicular to the longitudinal direction (hereinafter also referred to as a width direction) of the frame 25.

Figure 8:
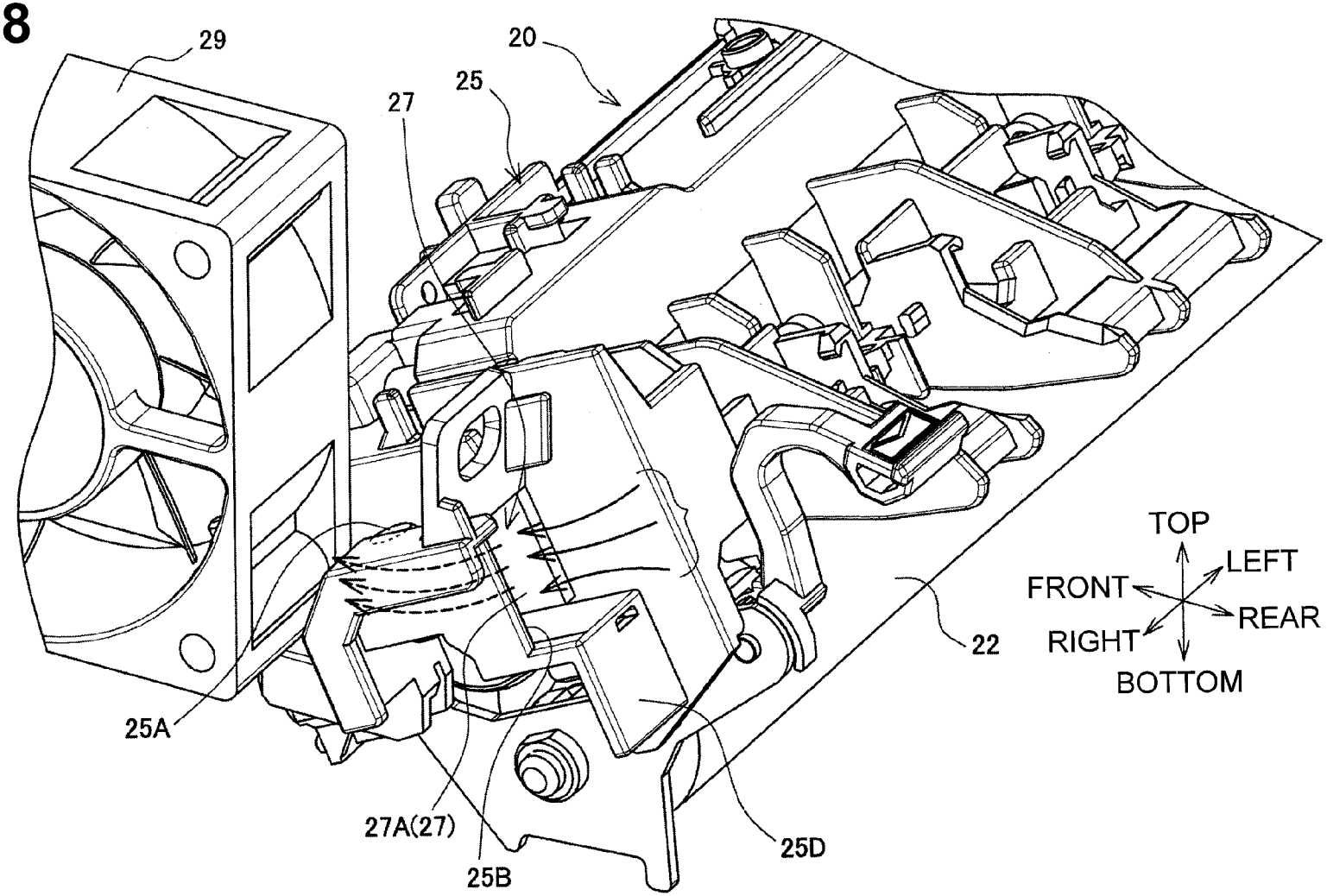
FIG. 8 is an enlarged view of one end portion of a frame in a longitudinal direction thereof.

As illustrated in FIG. 8, the lead-in portion 27A is an inlet, which is open in a direction perpendicular to the width direction (e.g., rearward in this embodiment) for leading air in. As illustrated in FIG. 7, the lead-out portion 27B is an outlet, which is open in a direction perpendicular to the width direction (e.g., toward the front side in this embodiment) for leading the air, led in from the lead-in portion 27A, out.

As illustrated in FIG. 2, an opening of the lead-in portion 27A has substantially a rectangular shape. A fan 29 is disposed downstream of the duct portion 27 in an airflow direction or closer to the lead-out portion 27B than to the lead-in portion 27A. The fan 29 is configured to generate airflow directed from the lead-in portion 27A toward the lead-out portion 27B, draw in air emitted from the lead-out portion 27B and emit the air outside the casing 3. In this embodiment, the fan 29 is an axial fan with propeller blades that blows air axially.

Figure 6:
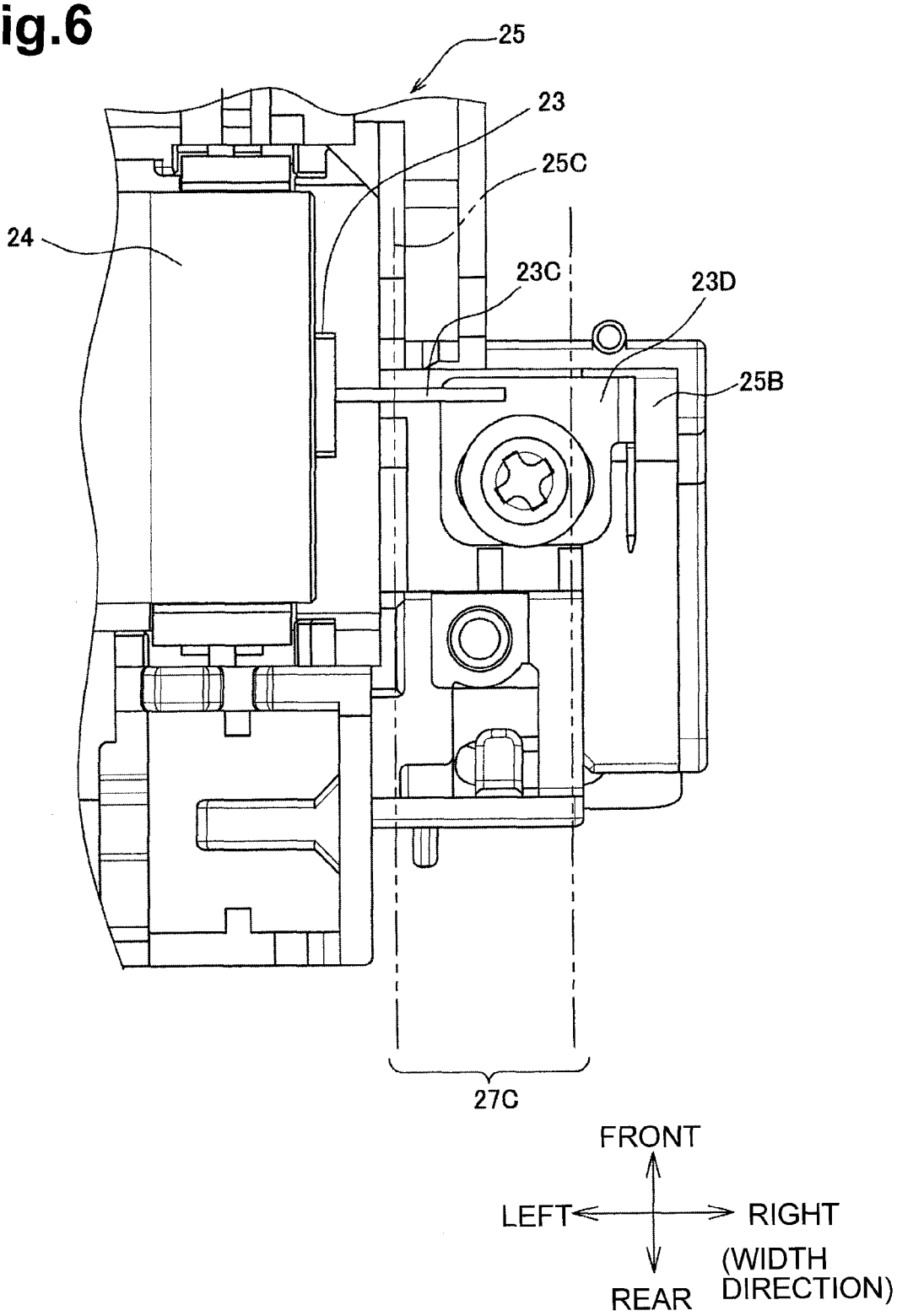
FIG. 6 is an enlarged view of a part A illustrated in FIG. 4.

As illustrated in FIG. 6, the duct portion 27 or the airflow path 27C (which is an area between phantom lines) is provided closer to an exterior of the image forming apparatus 1 than the cylindrical member 24 in the width direction (or is provided father to the right than the cylindrical member 24 in this embodiment).

The duct portion 27 according to this embodiment is disposed on the upper surface of the right support plate portion 25B or the back side of the support plate portion 25B illustrated in FIG. 6. The duct portion 27 or the airflow path 27C is defined by the right support plate portion 25B and a vertical wall portion 25C as illustrated in FIG. 7. Thus, as illustrated in FIG. 6, the support terminal 23D and the screw 23E, which are located on the right side, are located toward an external wall of the duct portion 27 forming the airflow path 27C. In other words, the support terminal 23D and the screw 23E are located on a side of the support plate portion 25B opposite to the duct portion 27.

The upper surface of the support plate portion 25B and the vertical wall portion 25C extend in the direction perpendicular to the longitudinal direction of the frame 25 and form guide surfaces for guiding air directed from the lead-in portion 27A to the lead-out portion 27B. The vertical wall portion 25C is a wall portion formed of resin integrally with the fame 25 and dividing the one end portion of the frame 25 into an area having the cylindrical member 24 and an area having the support terminal 23D.

Figure 9:
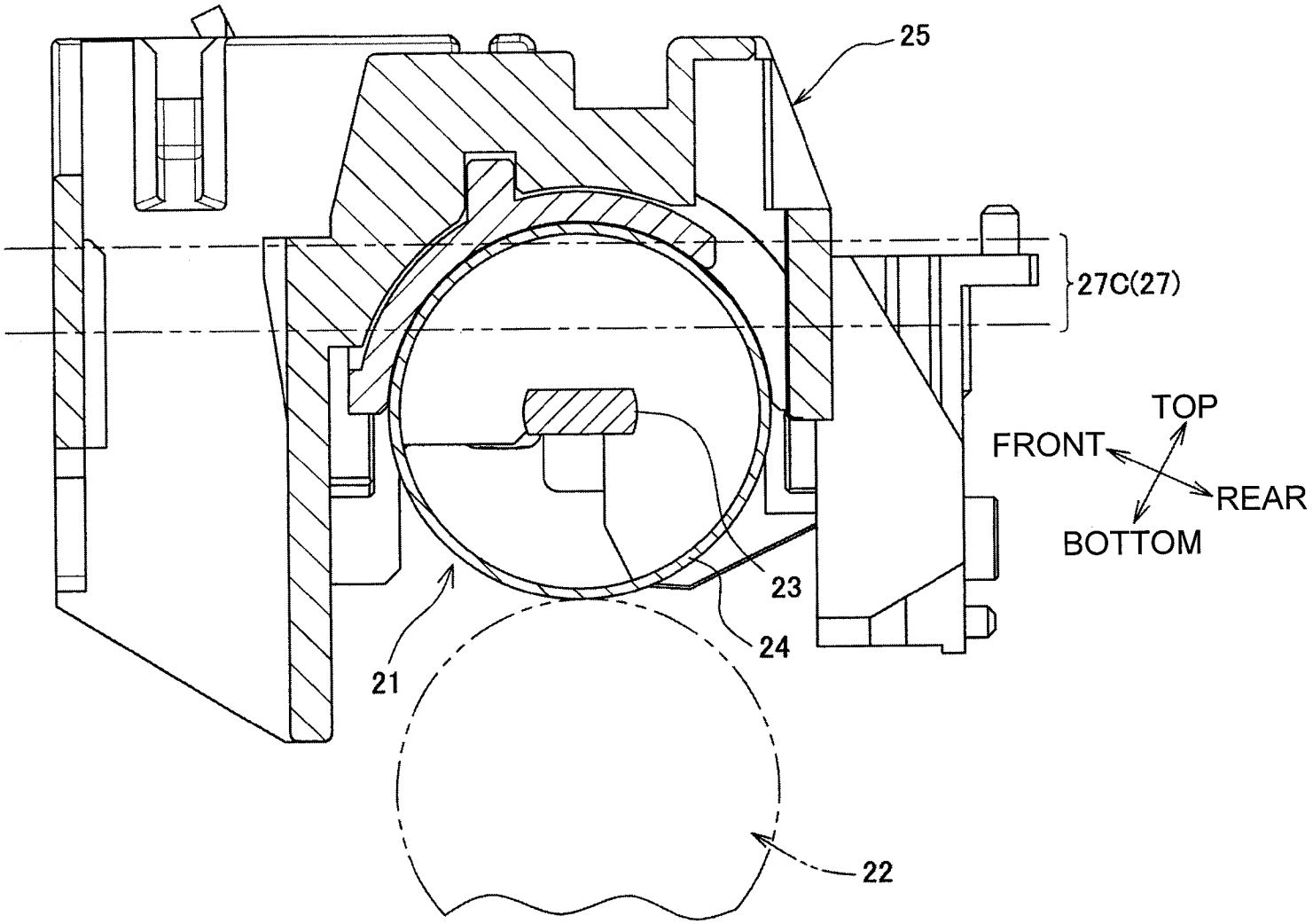
FIG. 9 is a cross sectional view on an imaginary plane perpendicular to a width direction.

As illustrated in FIG. 9, the frame 25 is shaped like a gutter, which covers the heating member 21 and is open toward the pressing member 22. The cylindrical member 24 projected onto an imaginary plane perpendicular to the width direction at least partially overlaps the duct portion 27 or the airflow path 27C projected onto the imaginary plane.

Specifically, the airflow path 27C projected onto the imaginary plane overlaps a part of the cylindrical member 24 projected onto the imaginary plane at a position offset from a center of the cylindrical member 24. As illustrated in FIG. 8, the frame 25 is provided with a blocking wall 25D extending from near the lead-in portion 27A of the duct portion 27 toward the pressing member 22 (that is, downward in this embodiment).

The blocking wall 25D is shaped like a strip extending downward from an end portion of the support plate portion 25B closer to the lead-in portion 27A. The blocking wall 25D is formed of resin integrally with the frame 25.

In this embodiment, the support terminals 23D integral with the heater 23 are fixed to the frame 25 made of resin as illustrated in FIG. 4. When the temperature of the frame 25 rises due to the support terminals 23D heated by the heater 23, ultra-fine particles may be produced from the frame 25.

In this embodiment, however, as the frame 25 is provided with the duct portion 27 on one end portion thereof in the longitudinal direction as illustrated in FIG. 8, the one end portion of the frame 25 can be subjected to cooling by air led through the duct portion 27.

This cooling can prevent excessive temperature rise of the resin constituting the frame 25, and thus prevent an occurrence of ultra-fine particles from the frame 25. In other words, this cooling can prevent the emission of ultra-fine particles from the image forming apparatus 1.

As illustrated in FIG. 7, the duct portion 27 according to this embodiment is configured to let the air led therein flow in the direction perpendicular to the longitudinal direction of the frame 25. This can prevent the air led in the duct portion 27 (hereinafter also referred to as air for cooling) from flowing in the cylindrical member 24.

Thus, in this embodiment, the extreme drop in heating temperature of the heating member 21, which may lead to a failure in fixing developer images, can be prevented, and the emission of ultra-fine particles from the frame 25 can be prevented.

As illustrated in FIG. 2, the fan 29 according to this embodiment is disposed downstream of the duct portion 27 in the airflow direction. As air in the image forming apparatus 1 is drawn into the fan 29, air heated by the heater 23 is collected to the end portion of the frame 25 in the longitudinal direction to which the fan 29 is disposed.

Thus, the temperature of the frame 25 greatly rises at the end portion thereof in the longitudinal direction, compared with other portions of the frame 25, and thus there is a possibility that ultra-fine particles may occur at the end portion of the frame 25. In this embodiment, however, as the duct portion 27 for leading air for cooling is disposed proximate to the end portion of the frame 25, the end portion of the frame 25 is subjected to cooling to prevent excessive rise in temperature. Thus, ultra-fine particles can be prevented from occurring at the end portion of the frame 25.

As illustrated in FIG. 7, the duct portion 27 includes the vertical wall portion 25C made of resin and extending perpendicularly to the longitudinal direction of the frame 25 to divide the end portion of the frame 25 into the area having the cylindrical member 24 and the area having the support terminal 23D.

The vertical wall portion 25C can prevent the excessive drop in the temperature of the cylindrical member 24 or the heating member 21 and the excessive rise in the temperature of the vertical wall portion 25C. Thus, the emission of ultra-fine particles from the vertical wall portion 25C can be prevented.

The heat emitted from the heater 23 accumulates within the cylindrical member 24 as illustrated in FIG. 5, and the heat (hot air) with nowhere to go is emitted outside from openings of the cylindrical member 24 provided at respective ends in an axial direction of the cylindrical member 24.

Thus, portions of the frame 25 proximate to the openings of the cylindrical member 24 are most likely to get hot. In the embodiment, as illustrated in FIG. 9, the cylindrical member 24 projected onto the imaginary plane at least partially overlaps the duct portion 27 projected onto the imaginary plane.

The portions of the frame 25 most likely to get hot, that is, the portions of the frame 25 proximate to the openings of the cylindrical member 24 can be subjected to cooling by air for cooling, which is led to the duct portion 27. Thus, occurrence of ultra-fine particles can be prevented.

In this embodiment, the support terminal 23D is located toward the external wall of the duct portion 27 forming the airflow path 27C, that is, toward the lower surface of the support plate portion 25B, which is opposite to the duct portion 27. With this structure, the metal-made support terminal 23D integral with the heater 23 can be subjected to cooling by the air for cooling via the support plate portion 25B.

In this embodiment, the metal-made screw 23E fixing the support terminal 23D to the frame 25 is located toward the external wall of the duct portion 27 forming the airflow path 27C, that is, toward the lower surface of the support plate portion 25B, which is opposite to the duct portion 27. With this structure, the metal-made screw 23E prone to get hot can be subjected to cooling by air for cooling via the support plate portion 25B.

In this embodiment, the frame 25 is shaped like a gutter, which is open toward the pressing member 22 and covers the heating member 21 and the frame 25 is provided with the blocking wall 25D extending from near the lead-in portion 27A of the duct portion 27 toward the pressing member 22.

With this structure, any portion of the frame 25 having a high possibility of losing its function due to the drop in temperature of the cylindrical member 24 can be prevented from being exposed to air for cooling.

Figure 10:
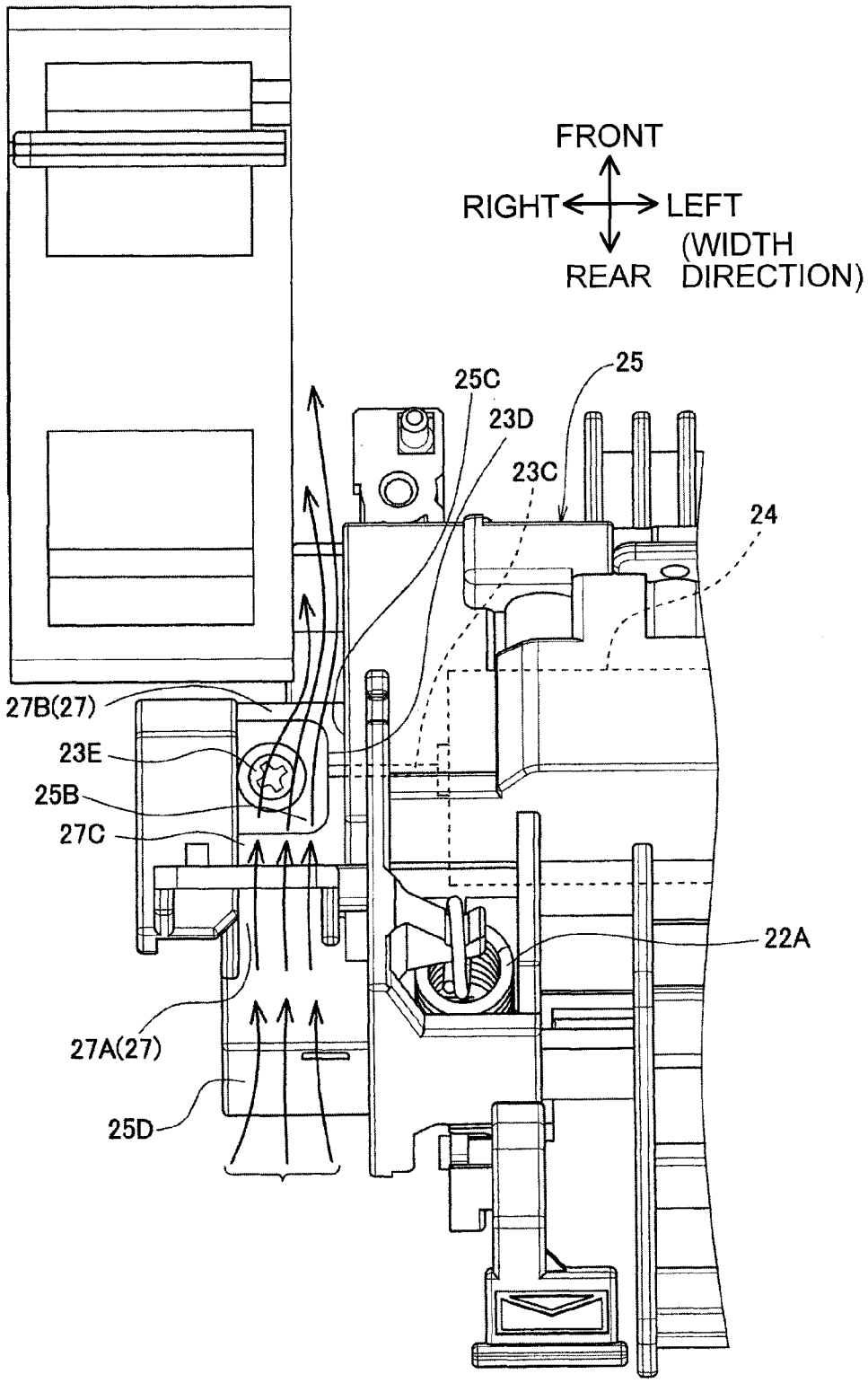
FIG. 10 is a rear view of a part of a fixing unit according to a second embodiment, the part corresponding to the part A of FIG. 4.

A second embodiment will be described with reference to FIG. 10. The first embodiment illustrates that the screw 23E and the support terminal 23D are located toward the external wall of the duct portion 27 forming the airflow path 27C, that is, toward the lower surface of the support plate portion 25B, which is opposite to the duct portion 27. In the second embodiment, as illustrated in FIG. 10, the screw 23E and the support terminal 23D are disposed in the duct portion 27 forming the airflow path 27C.

In the second embodiment, the support terminal 23D, which is integral with the heater 23, and the metal-made screw 23E, which is likely to get hot, can be exposed to air for cooling. Thus, the one end portion of the frame 25 in the longitudinal direction can be reliably subjected to cooling.

The embodiment shows, but is not limited to, the fan 29 being an axial fan with propeller blades that blows air axially. The fan may be a fan of other type, such as a centrifugal fan.

The embodiment shows, but is not limited to, the fan 29 being disposed downstream of the duct portion 27 in the airflow direction to draw in air and emit the air outside of the casing 3. The fan 29 may be disposed upstream of the duct portion 27 in the airflow direction to draw in air from outside of the casing 3 and force the air into the casing 3.

The embodiment shows, but is not limited to, the duct portion 27 being provided closer to the exterior of the image forming apparatus 1 than the cylindrical member 24 in the width direction.

The embodiment shows, but is not limited to, the duct portion 27 letting air flow in the direction perpendicular to the longitudinal direction of the frame 25. The duct portion may be configured to let the air flow in a direction crossing the width direction.

The embodiment shows, but is not limited to, the blocking wall 25D extending from near the lead-in portion 27A toward the pressing member 22. The blocking wall 25D may be omitted.

The embodiment shows, but is not limited to, the image forming apparatus 1 for forming images in color. The disclosure may be applied to an image forming apparatus for forming images in monochrome.

The embodiment shows, but is not limited to, the image forming apparatus 1 of a direct transfer type in which developer images are directly transferred onto a sheet conveyed on the belt 13. The image forming apparatus may be of an intermediate transfer type in which developer images are first transferred onto the belt and then transferred from the belt to a sheet.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus configured to form an image on a sheet, the image forming apparatus comprising:

a photosensitive member configured to carry a developer image thereon;

a fixing device including:

a heating member configured to heat the developer image transferred from the photosensitive member onto the sheet;

a pressing member configured to press the sheet toward the heating member; and a frame; and a fan configured to generate airflow, wherein the heating member includes:

a heater configured to generate heat and extending in a direction parallel to a width direction of the sheet being fed;

a cylindrical member storing the heater therein, each end of the cylindrical member in an axial direction thereof being open; and first and second support terminals disposed at first and second ends of the heater, respectively, in a longitudinal direction of the heater, the first and second support terminals supporting the heater, wherein the frame is made of resin, and includes a first support terminal supporting portion supporting the first support terminal of the heater and a second support terminal supporting portion supporting the second support terminal of the heater, wherein the fan is disposed proximate to the first support terminal supporting portion, and wherein the frame further includes a duct portion disposed proximate to the first support terminal supporting portion, the duct portion through which air flows to the fan.

2. The image forming apparatus according to claim 1, wherein the duct portion is provided closer to an exterior of the image forming apparatus than the cylindrical member in the width direction.

3. The image forming apparatus according to claim 1, wherein the duct portion is configured to allow the air to flow in a direction crossing the longitudinal direction of the frame.

4. The image forming apparatus according to claim 1, wherein the fan is disposed downstream of the duct portion in an airflow direction.

5. The image forming apparatus according to claim 1, wherein the duct portion includes a wall portion made of resin and extending perpendicularly to the longitudinal direction of the frame, the wall portion being configured to divide an area of the frame into an area having the cylindrical member and an area having the first support terminal.

6. The image forming apparatus according to claim 1, wherein the cylindrical member projected on an imaginary plane perpendicular to the width direction at least partially overlaps the duct portion projected on the imaginary plane.

7. The image forming apparatus according to claim 1, wherein the first support terminal is disposed within an airflow path defined by the duct portion.

8. The image forming apparatus according to claim 7, wherein the first support terminal is fixed to the frame by a metal screw, the metal screw being disposed within the airflow path.

9. The image forming apparatus according to claim 1, wherein the first support terminal is located toward an external wall of the duct portion forming an airflow path.

10. The image forming apparatus according to claim 9, wherein the first support terminal is fixed to the frame by a metal screw, the metal screw being located toward the external wall of the duct portion.

11. The image forming apparatus according to claim 1, wherein the frame is shaped like a gutter, which is open toward the pressing member and covers the heating member.

12. The image forming apparatus according to claim 1, wherein the frame is provided with a blocking wall extending from near an inlet of the duct portion toward the pressing member.

13. The image forming apparatus according to claim 12, wherein the inlet of the duct portion has substantially a rectangle shape.

14. The image forming apparatus according to claim 1, wherein the first support terminal supporting portion has a first surface and a second surface opposite to the first surface, the first surface contacting the first support terminal, the second surface defining a part of the duct portion.

15. A fixing device for use in an electrophotographic image forming apparatus, the fixing device comprising:

a heating member configured to heat a developer image transferred from a photosensitive member onto a sheet;

a pressing member configured to press the sheet toward the heating member; and a frame, wherein the heating member includes:

a heater configured to generate heat and extending in a direction parallel to a width direction of the sheet being fed;

a cylindrical member storing the heater therein, each end of the cylindrical member in an axial direction thereof being open; and first and second support terminals disposed at first and second ends of the heater, respectively, in a longitudinal direction of the heater, the first and second support terminals supporting the heater, wherein the frame is made of resin, and includes a first support terminal supporting portion supporting the first support terminal of the heater and a second support terminal supporting portion supporting the second support terminal of the heater, and wherein the frame further includes a duct portion disposed proximate to the first support terminal supporting portion, the duct portion through which air flows to a fan.

16. The fixing device according to claim 15, wherein the duct portion is provided closer to an exterior of the image forming apparatus than the cylindrical member in the width direction.

17. The fixing device according to claim 15, wherein the duct portion is configured to allow the air to flow in a direction crossing the longitudinal direction of the frame.

* * * * *